US006001025A

United States Patent [19]

Blackmon

[11] Patent Number: 6,001,025

[45] Date of Patent: Dec. 14, 1999

[54] GOLF PUTTING AID

[76] Inventor: David T. Blackmon, 70 Clement Dr., Oakfield, Tenn. 38362

[21] Appl. No.: 09/107,783

[22] Filed: Jun. 30, 1998

[51] Int. Cl.[6] ..... A63B 69/36

[52] U.S. Cl. ..... 473/256; 473/231; 473/233; 473/241; 473/326; 473/404

[58] Field of Search ..... 473/226, 219, 473/224, 241, 233, 234, 232, 238, 256, 326, 341, 231, 404, 407, 409

[56] References Cited

U.S. PATENT DOCUMENTS 3,951,413 4/1976 Bilyeu ..... 473/326
3,971,559 7/1976 Diforte ..... 473/256 X
4,330,128 5/1982 Morelli ..... 473/326 X
5,580,321 12/1996 Rennhack ..... 473/234
5,620,376 4/1997 Hsu ..... 473/233
5,628,697 5/1997 Gamble ..... 473/326

*Primary Examiner*—George J. Marlo
*Attorney, Agent, or Firm*—Dority & Manning

[57] ABSTRACT

A golf putting aid is provided having an elongated body member difining an interior cavity. An attaching device, such as a clamp, is configured on the body member to removably secure the body member to the shaft of a golf putter. A weighted mass, such as a fluid, fills a portion of the interior cavity of the body member to increase the smoothness and follow through of a putt stroke.

16 Claims, 5 Drawing Sheets

GOLF PUTTING AID

BACKGROUND OF THE INVENTION

The present invention relates to a golf training aid, and more particularly to a device to improve a golfer's putting stroke.

Golf training aids that are attachable to the shaft of a golf club are known in the art. For example, U.S. Pat. No. 5,527,039 relates to a training aid to assist the golfer in visualizing the action of the golf club head during the arc of a golf swing. U.S. Pat. No. 2,607,209 relates to a golf club direction indicator attachment for a putter to enable to golfer to align the club in relation to the ball to obtain a visual indication of the direction in which the club head is facing in order to predetermine with some degree of accuracy the direction the ball will take when struck by the putter or club.

The putting stroke is perhaps one of the hardest in the game of golf. The transition from the rearward stroke to the forward stroke and the follow through of the putter head after contact with the ball are critical to a good putt. The present invention relates to a putting aid attachable to the putter shaft that helps to control the transition from the rearward stroke to the forward stroke to keep the putter head on a straight plane or line in a smooth action through the stroke while also ensuring a complete follow through of the stroke.

OBJECTS AND SUMMARY OF THE INVENTION

It is therefore a principal object of the present invention to provide a training tool or aid to improve a golfer's game.

An additional object of the present invention is to provide a device that is attachable to a putter to improve the putt stroke.

Additional objects and advantages of the invention will be set forth in part in the following description, or may be obvious from the description, or may be learned through practice of the invention.

In accordance with the objects and purposes of the invention, a golf putting aid is provided. The putting aid comprises an elongated body member, such as a tubular member, that defines an interior volume or cavity. An attaching device, such as a clamp, is configured on the body member so that the body member can be removably attached to the shaft of a putter with the body member longitudinally aligned generally perpendicular to the face of the putter head. A movable or flowable weighted mass fills at least a portion of the interior cavity of the body member and is movable from one end of the interior cavity to the other.

The weighted mass within the interior cavity of the body member is preferably flowable, and may be, for example, a liquid. In a preferred embodiment of the invention, the flowable liquid is a hydraulic oil. The invention also encompasses other types of movable or flowable weighted masses. For example, rolling bodies, such as steel shot or ball bearings, may be disposed within the body cavity to act as the weighted mass. Any number of substances can be utilized in this regard to provide a weighted mass that is movable from one end of the body cavity to the other during the putt stroke, as will be described in greater detail below.

The putting aid is attached to the shaft of the putter generally near the club head. The weighted mass within the body cavity ensures a smooth putt stroke, particularly at the transition from the rearward stroke to the forward stroke, and causes the putter head to follow through with the stroke once the putter head contacts the golf ball.

The interior cavity of the body member can take on any configuration. In a preferred embodiment, the interior cavity is defined as a generally cylindrical cavity within an elongated body member. This is a particularly useful configuration wherein the body member is formed of plastic material and injection molded. The cylindrical interior cavity may also have a slight taper in the direction of the forward end thereof.

The invention will be described in greater detail below by way of the example illustrated in the accompanying drawings.

DETAILED DESCRIPTION

Figure 1:
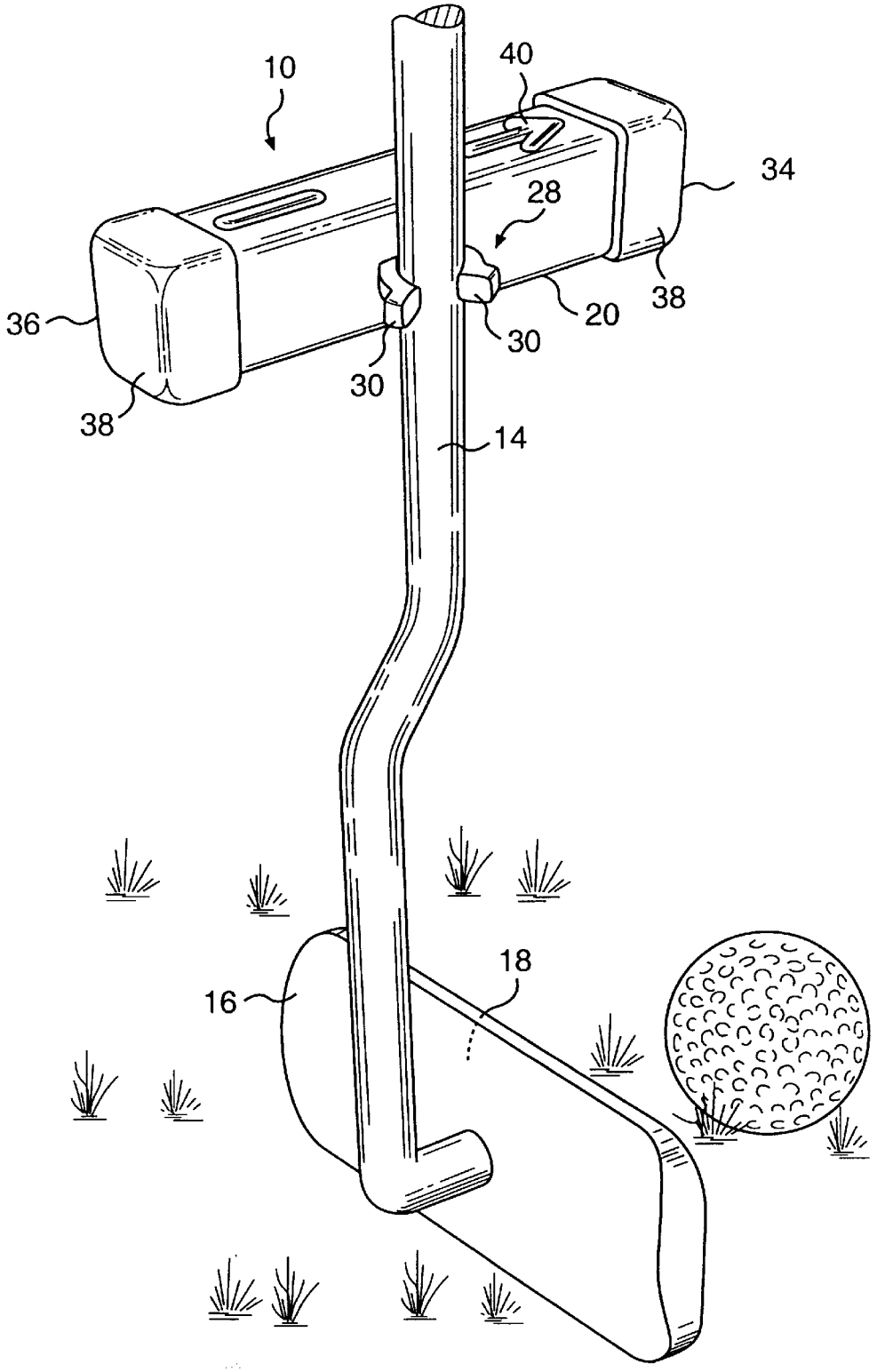
FIG. 1 is a perspective view of a golf putter incorporating the training aid according to the invention.
Figure 2:
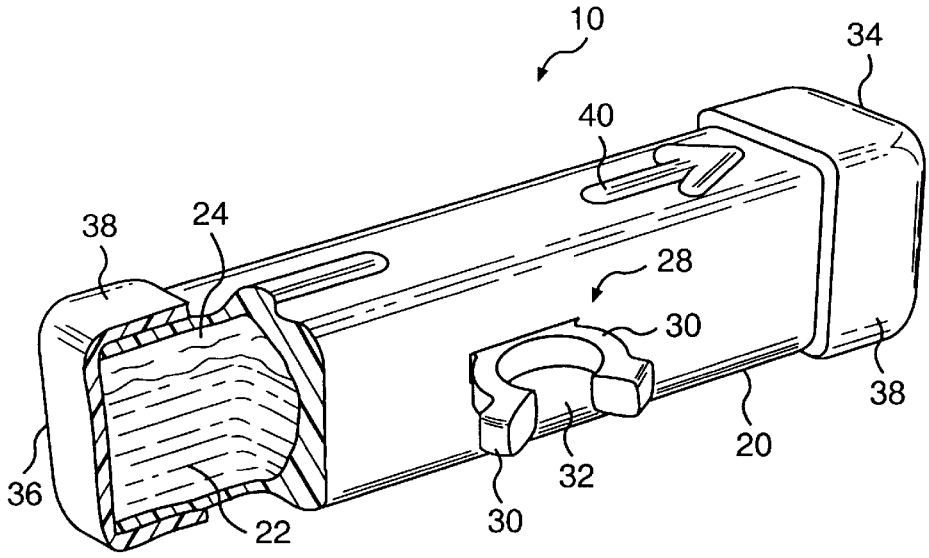
FIG. 2 is a partial cross-sectional view of the putting aid according to the invention.
Figure 3:
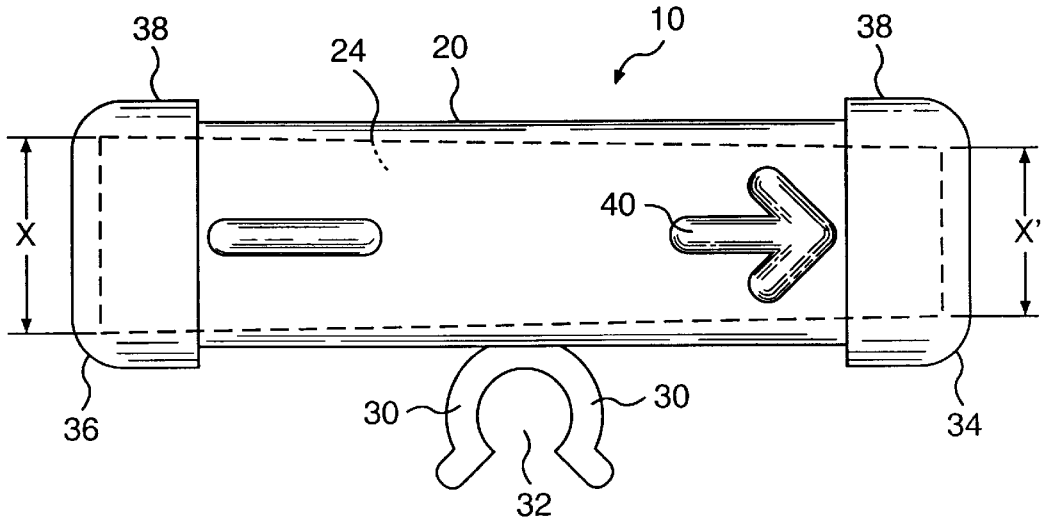
FIG. 3 is a top view of the device illustrated in FIG. 2 particularly illustrating in diagrammatic form the taper of the interior body or cavity.

Reference will now be made in detail to the presently preferred embodiments of the invention, one or more examples of which are illustrated in the drawings. Each example is provided by way of explanation of the invention, and not limitation of the invention. For example, features illustrated or described as part of one embodiment can be used on another embodiment to yield still a further embodiment. It is intended that the present invention include such modifications and variations as come within the scope and spirit of the invention.

Putting aid 10 according to the invention is illustrated in the figures attached to a shaft 14 of any conventional putter having a putting head 16 and a putting face 18. Putting aid 10 is preferably attached along shaft 14 relatively close to putting head 16 without interfering with the golfer's view of the putting head 16 and golf ball. It should be appreciated that device 10 is not limited to any particular type of putter and may be utilized with any conventional putter.

Putting aid 10 includes an elongated body member, generally 20. In the embodiment illustrated, body member 20 is formed form a lightweight molded plastic material and has an outward generally rectangular shape. Body member 20 defines an interior cavity or space, generally 24. In the embodiment illustrated, interior cavity or space 24 is cylindrical and defined between end caps 38 secured to body member 20. It should be appreciated, however, that elongated body member 20 and interior cavity or space 24 can take on virtually any elongated geometric configuration.

The majority of golfers putt with a backstroke of between about six inches to twelve inches. With this backstroke, applicant has empirically determined that a preferred configuration of body member 20 is the lightweight plastic member, as indicated in the figures, defining a generally cylindrical interior cavity 24 having a length of about 3.7 inches. This generally cylindrical cavity may be slightly tapered towards forward end 34 from a diameter of about 0.82 inches at rearward end 36 to about 0.76 inches at forward end 34. Body member 20 has a generally rectangular outer shape having a width of about 0.87 inches and a height of about 1.08 inches.

An attaching device, generally 28, is configured on body member 20 so that putting aid 10 can be removably attached to shaft 14 of the putter. Any conventional attaching device may be utilized in this regard. In the embodiment illustrated, attaching device 28 is defined by resilient or flexible arms 30 defining a space 32 therebetween for receiving shaft 14. Attaching device 28 allows putting aid 10 to be rotated or turned relative to shaft 14 so that forward end 34 is aligned generally perpendicular to putting face 18, as particularly illustrated in FIGS. 4*a* through 4*e*.

Body member 28 may also include markings, such as arrow 40, to indicate forward end 34.

Putting aid 10 includes a weighted mass, generally 22, at least partially filling interior cavity or space 24. In the preferred embodiment of the invention, weighted mass 22 is a flowable mass, such as a fluid. The preferred fluid is a hydraulic oil commercially available from Texaco as "cygnus hydraulic oil 32" with a product number of 2665P. Applicant has found that this particular hydraulic oil has the viscosity and flow rate characteristics desirable in the present invention. It should be appreciated, however, that any number of substances may be utilized as weighted mass 22. For example, rolling bodies, such as steel shot or ball bearings may be utilized in this regard. A fine granular or particulate material may also have the desired flowable characteristics. Any and all such types of movable or flowable weighted masses are within the scope and spirit of the invention.

Weighted mass 22 only partially fills interior cavity 24 so as to be movable within the cavity. In the preferred embodiment having the dimensions set forth above, applicant has found that, for the cylindrical interior cavity having a length of about 3.7 inches at the stated diameter, about 0.81 inches of the cavity 24 should remain as a free or open space with the remaining portion of the cavity being filled with the weighted mass 22.

It should be appreciated that any number of factors and variables contribute to the invention. For example, the viscosity or flow rate characteristics of weighted mass 22 will effect the amount of the weighted mass within cavity 24. Likewise, the dimensions and shape of cavity 24 will also effect the amount and type of weighted mass 22 to be utilized, as well as the timing of the effects of putting aid 10 during the putt stroke. Although it has empirically determined that the dimensions and characteristics described herein are preferred for conventional putting strokes between 6 and 12 inches, this is not a limitation of the invention and it should be appreciated that any number of variables and factors can be changed while remaining within the scope and spirit of the invention. For example, body member 20 may be shorter or longer; interior cavity 24 may have any geometric shape or volume; and any manner of weighted substance may be movable within the cavity.

Figure 4A:
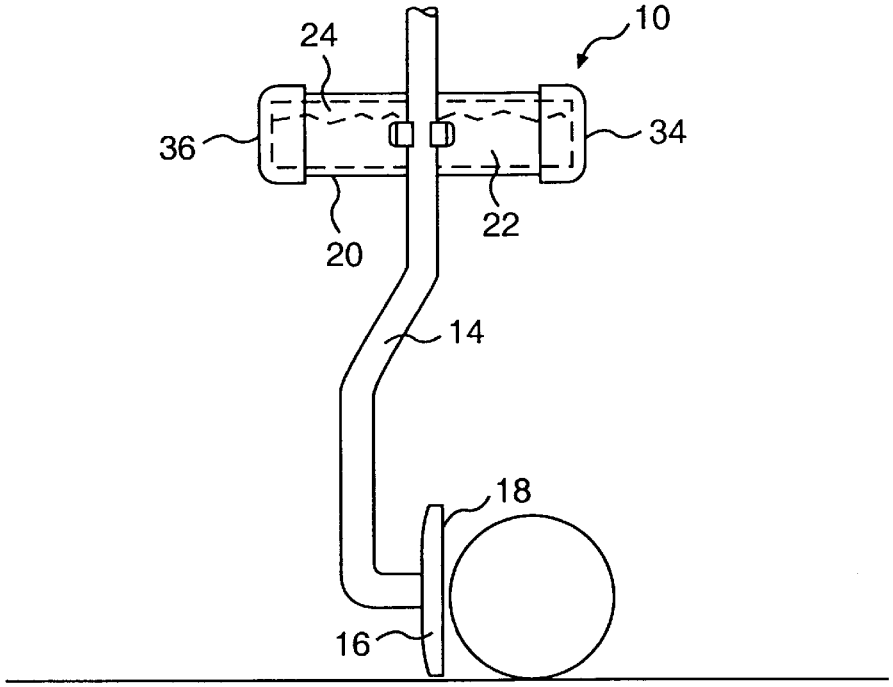
FIGS. 4*a* through 4*e* are sequential operational views of the putting aid through a complete putt stroke.

The operational principles of putting aid 10 are illustrated in the sequential FIGS. 4*a* through 4*e*. FIG. 4*a* illustrates the initial position of putter head 16 with putter face 18 adjacent to the golf ball. Putting aid 10 is attached to shaft 14 so that forward end 34 is perpendicular to the plane of putting face 18. The weighted mass 22, in this case hydraulic oil, is "settled" within interior cavity 24 so that, at this point, putting aid 10 acts essentially as a stationary weight. Putting aid 10 is also aligned to be essentially perpendicular to the axis of shaft 14.

Figure 4B:
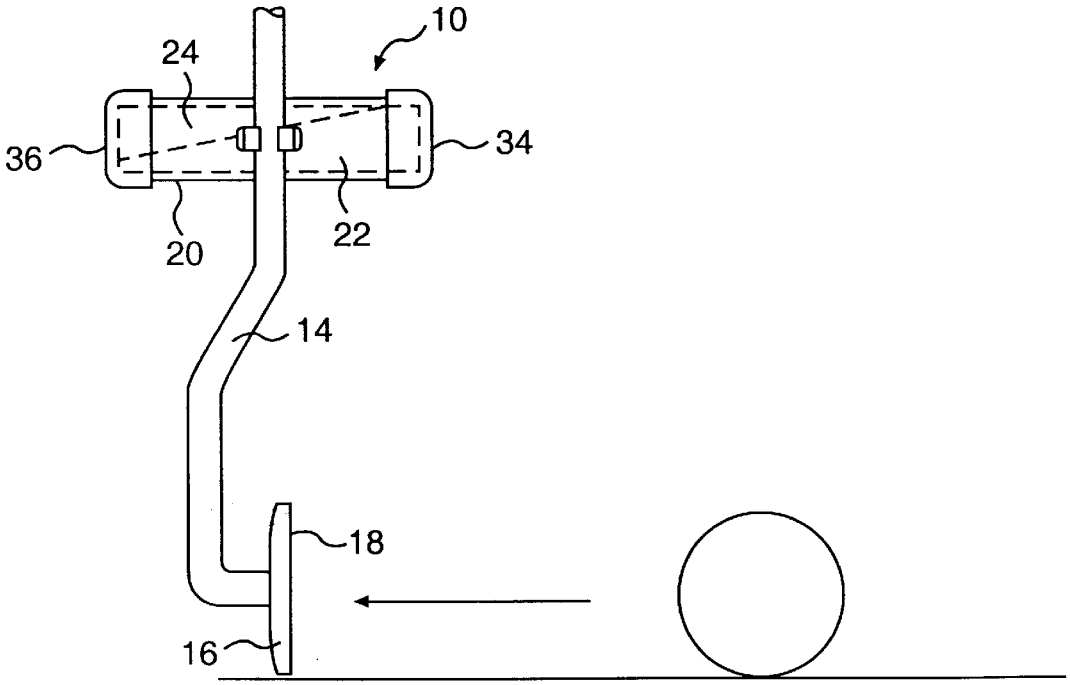

FIG. 4*b* illustrates the initial backstroke of the putter. As the putter is moved in the rearward direction, oil 22 moves generally forward within cavity 24 against forward end 34. Thus, oil 22 acts as a gradual "braking" force during the rearward stroke with the maximum breaking force occurring when the oil has transferred completely to forward end 34. The rate or timing of the braking force will depend on the club speed. Thus, in the initial rearward stroke, putting aid 10 provides a gradual dampening force.

Figure 4C:
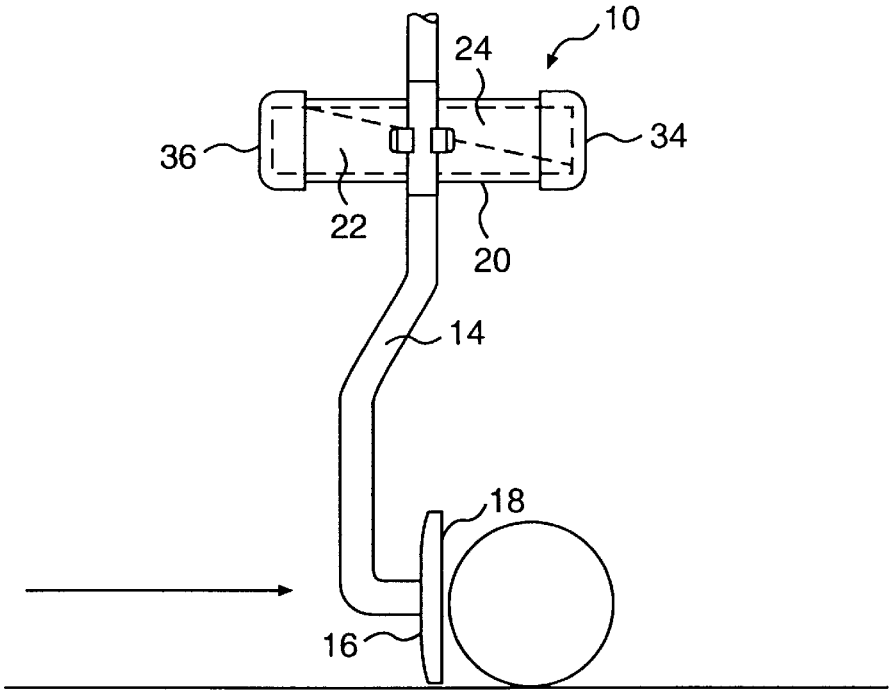

FIG. 4*c* illustrates the forward stroke portion of the putt stroke after the club head has changed direction. When the club changes direction, oil 22 within cavity 24 is essentially still travelling in the rearward direction and will impact against back end 36 of device 10 at some time after the club head is moving in the forward direction. Thus, oil 22 within chamber 24 does not impede the change of direction of the club, but applies a braking or dampening force just after the club changes direction to the forward stroke. The oil 22 moves rearward within the interior cavity 24 during the transition of the club head from the back stroke to the forward stroke at essentially the same rate of speed that the club head was moving in the rearward direction until the oil 22 is completely transferred to the rearward end 36 of interior cavity 24 just after the club as changed direction to the forward stroke. This action causes the putter head to follow a straighter line in the forward direction and to dampen any abrupt or "jerky" motions that may have occurred when the club head changed directions.

Figure 4D:
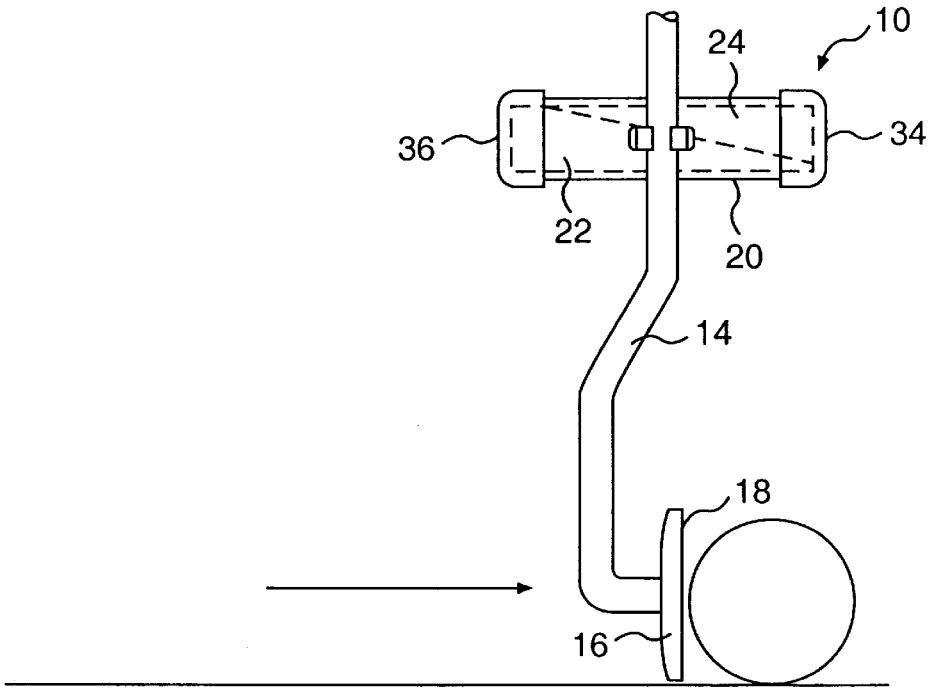
Figure 4E:
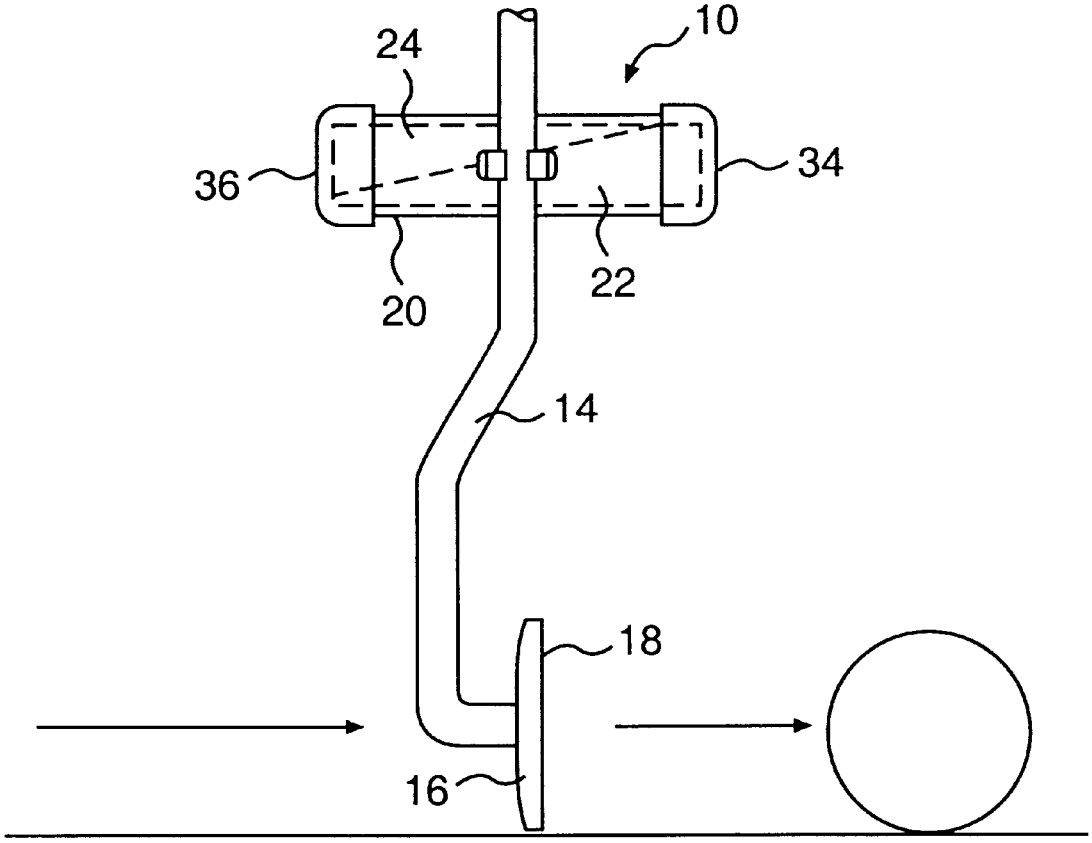

FIG. 4*d* illustrates club head 16 just after face 18 has impacted the golf ball. Oil 22 is at the rearward end 36 of cavity 24 and is travelling at essentially the same rate of speed as club head 16. FIG. 4*e* illustrates the conditions just after the golf ball has left putting face 18. The impact of face 18 against the golf ball exerts a braking force to the putter, but not to oil 22 within cavity 24 which continues to move in the forward direction at the previous rate of speed that the club head was moving in the forward direction just prior to impact with the golf ball. As indicated in FIG. 4*e*, oil 22 moves at this rate of speed to the forward end 34 of cavity 24 and thus imparts an additional force to the putter in the forward direction causing the putter to carry through in the follow through portion of the putt stroke.

Although FIGS. 4*a* through 4*e* are greatly exaggerated for purposes of explaining the invention, it should be appreciated that the putting aid 10 according to the invention acts to smooth out the backstroke, forward stroke, and causes the putter head to follow through with the putt stroke. The viscosity or flow rate of weighted mass 22 within cavity 24, as well as the free space within cavity 24, are important to the timing of the effects of the putting aid throughout the putt stroke.

A putting aid 10 constructed in accordance with the invention was tested using an LVDT and load cell mounted on a putter connected to a golf swing test machine. The putter was tested at a rearward stroke distance of from 1 inch through 24 inches. The putting aid caused the putter head to carry through the swing generally the same distance that the putter head was drawn in the rearward direction. At a rearward draw distance of about 19 inches, the putter head forward motion was decreased by about 1.7 inches, and at a rearward stroke of about 24 inches, the putter head forward motion was decreased by about 3.9 inches.

To verify that the results were not caused merely by the weight of the putting aid, the same test was conducted with a solid weight having the same weight as the putting aid and attached at the same location on the putter. The forward motion of the putter with the weight was consistently less than the rearward draw of the putter.

It should be appreciated by those skilled in the art that various modifications and variations can be made in the present invention without departing from the scope and spirit of the invention. It is intended that the present invention include such modifications and variations as come within the scope of the appended claims and their equivalents.

What is claimed is:

1. A golf putting aid, comprising:

an elongated body member defining an interior cavity;

an attaching device configured on said body member to removably secure said body member to a shaft of a golf putter so that said body member is longitudinally aligned generally perpendicular to a face of the putter head, and a weighted mass filling a portion of and movable within said interior cavity of said body member to increase the smoothness and follow through of a putt stroke.

2. The golf putting aid as in claim 1, wherein said elongated body member comprises a sealed tubular member.

3. The golf putting aid as in claim 1, wherein said attaching device comprises a clamping device.

4. The golf putting aid as in claim 3, wherein said clamping device comprises resilient arm members defining a recess therebetween for receipt of a putter shaft.

5. The golf putting aid as in claim 1, wherein said weighted mass comprises a flowable medium.

6. The golf putting aid as in claim 5, wherein said flowable medium is a fluid.

7. The golf putting aid as in claim 6, wherein said fluid is an oil.

8. The golf putting aid as in claim 1, wherein said body member comprises a forward end and said interior cavity comprises a generally cylindrical shape with a slight taper towards said forward end.

9. A golf putting aid, comprising:

a tubular body member defining a generally cylindrical interior cavity;

a clamping device configured on said body member to removably secure said body member to a shaft of a golf putter so that said body member is longitudinally aligned generally perpendicular to a face of the putter head, and a fluid filling a portion of and flowable within said interior cavity of said body member from one end thereof to an opposite end thereof to increase the smoothness and follow through of a putt stroke.

10. A golf putter, comprising:

a handle, a putter head with a putting face, and a shaft extending between said handle and said putter head;

an elongated body member attached to said shaft generally nearer said putter head so that said body member is longitudinally aligned generally perpendicular to said putting face; and a weighted mass filling a portion of and movable within said interior cavity of said body member to increase the smoothness and follow through of a putt stroke.

11. The golf putter as in claim 10, wherein said elongated body member comprises a sealed tubular member.

12. The golf putter as in claim 10, wherein said body member is removably attached to said shaft.

13. The golf putter as in claim 12, wherein said body member comprises a clamping device for attachment to said shaft.

14. The golf putter as in claim 10, wherein said weighted mass comprises a flowable medium.

15. The golf putter as in claim 14, wherein said flowable medium is a fluid.

16. The golf putter as in claim 15, wherein said fluid is an oil.

* * * * *